United States Patent [19]

Blatia et al.

[11] Patent Number: 5,039,268

[45] Date of Patent: Aug. 13, 1991

[54] SHEET BINDING APPARATUS AND BINDERS FOR USE THEREWITH

[75] Inventors: Sushil K. Blatia, Framingham; Paul E. Brefka, Southborough; Rath, Mihira K., Milford; Nick Misra, Hopkinton, all of Mass.; Roger N. Chevrette, Woonsocket, R.I.

[73] Assignee: Dennison Manufacturing Company, Framingham, Mass.

[21] Appl. No.: 351,879

[22] Filed: May 12, 1989

[51] Int. Cl.[5] ..... B42C 9/00

[52] U.S. Cl. ..... 412/37; 412/36; 281/21.1

[58] Field of Search ..... 281/21.1; 412/8, 900, 412/33, 34, 37, 36

[56] References Cited

U.S. PATENT DOCUMENTS

| | | | |
|---|---|---|---|
| 1,747,581 | 2/1930 | Frazier | 412/37 |
| 2,752,619 | 7/1956 | Hodge | 412/37 |
| 3,594,837 | 7/1971 | French | 412/37 X |
| 3,715,260 | 2/1973 | Dornemann et al. | 412/900 |
| 3,911,517 | 10/1975 | Davis | 412/37 |
| 3,992,741 | 11/1976 | Staats | 412/900 |
| 3,995,886 | 12/1976 | Staats | 281/21.1 |
| 4,117,800 | 10/1978 | Maus et al. | 412/37 X |
| 4,141,100 | 2/1979 | Domroe et al. | 281/21.1 X |
| 4,416,722 | 11/1983 | Bergman et al. | 412/37 X |
| 4,518,296 | 5/1985 | Pearson | 412/37 |
| 4,606,689 | 10/1986 | Wiholm | 412/8 |
| 4,861,212 | 8/1989 | Cordia | 412/36 |

*Primary Examiner*—Paul A. Bell

*Attorney, Agent, or Firm*—Arthur B. Moore

[57] ABSTRACT

Apparatus for binding a plurality of sheets of paper or other media, including an assembly for clamping a plurality of sheets together with binding edges of respective sheets in alignment, and an assembly for coating the binding edges of the sheets with a quick-drying adhesive. The coating assembly advantageously includes an applicator member such as a porous pad, a supply of adhesive to the applicator member and a slidable mounting for the applicator member to guide the member along the binding edges of the clamped sheets. The applicator pad and adhesive may be contained in a telescoping housing which opens to expose the applicator pad during the process of sliding the housing toward and along the binding edges of the sheets. Although such binding apparatus may be used alone for "padding" the sheets, it is preferably used in conjunction with a cover folder which includes a stiff spine having a band of pressure sensitive adhesive within an inner channel to which is secured the adhesive-coated edge of the sheets. Advantageously such folder also includes front and back covers. The inner adhesive coating in the channel may be covered with a protective tape to be removed either before or after insertion of the adhesive-coated sheets.

5 Claims, 22 Drawing Sheets

SHEET BINDING APPARATUS AND BINDERS FOR USE THEREWITH

The present invention relates to systems for binding a plurality of sheets of paper and the like, and more particularly to "desk-top" binding systems for creating bound reports and the like.

A variety of "desk-top" binding systems for creating reports are currently commercially available. Some of these systems are manually operated, i.e. do not require electricity, such as spiral binding machines. Such machines typically require perforation of the edges to be bound and do not provide a professional book bound appearance. Such spiral binding systems and other systems (e.g. employing rivets or posts or prong binders) are expensive in terms of the cost per binding.

Thermal binding methods the best known of which employs hot melt adhesives, are relatively time consuming, require electricity, and involve high temperatures and risk of injury.

Accordingly, it is a primary object of the invention to provide an efficient desk-top binding system which permits the permanent binding of a plurality of sheets in a professional looking report. Such binding system desirably should be relatively inexpensive to use, measuring the average cost per binding. It is further desirable to enable the production of reports which open flat and securely bind the edges of the sheets.

Other objects are the design of portable, relatively light weight apparatus. Such apparatus should be safe and easy to use, yet another object is to provide a method for "volume padding" i.e. the binding together of a large number of sheets with no external support structure.

SUMMARY OF THE INVENTION

In fulfilling the above and additional objects the invention provides apparatus for binding sheets of paper and the like, comprising means for clamping a plurality of sheets with binding edges of said sheets in alignment; and means for coating the binding edges of said sheets with a first adhesive. The coating means includes an applicator member, a supply of said first adhesive to wet said applicator member, and means for guiding said applicator member along the binding edges of the sheets. In the perferred embodiment the applicator member is a porous pad. Advantageously the applicator member and adhesive are housed in a telescoping housing, wherein the housing may be telescoped to expose the applicator pad in preparation for coating the binding edges of the sheets with said first adhesive. Such telescoping housing may include a cover for the applicator pad and adhesive, and a container for the adhesive slidably mounted within the cover so that it may be extended to expose the pad through a window in the cover.

In accordance with one aspect of the invention, the clamping means and coating means may be mounted to a frame, wherein the frame and a housing for the applicator pad and adhesive are configured to provide a cam-cam follower structure which causes the housing to telescope and expose the applicator pad during the process of sliding the housing toward and along the binding edges of the clamped sheets. Preferably the clamping means comprises a tray having an edge surface for aligning the sheets, a panel substantially parallel to the tray and mounted to provide an adjustable separation of the panel and tray, and means for adjusting the separation of the tray and panel and for biasing these structures toward each other as they are moved closer together. In the preferred embodiment of the invention, the tray and panel are pivotally mounted to move between a position at which sheets may be inserted between them for alignment of the binding edges of the sheets against a stacking surface, and a position at which the sheets are clamped in place and the binding edges are exposed for coating with said first adhesive.

In accordance with a further aspect of the invention, coating means comprises a replacable cartridge holding a supply of said first adhesive, which cartridge is removably mounted to said apparatus to permit replacement with a new cartridge when the supply of adhesive is exhausted.

In the preferred embodiment of the invention, in which the binding apparatus is used for binding sheets within a binding cover, the binding cover comprises first and second cover sheets joined to a spine member, said spine member including a channel having a pressure sensitive adhesive layer. In such embodiment, after coating the binding edges of the sheet with said first adhesive and waiting for a sufficient period of time to permit the first adhesive to dry, the bound sheets are inserted in said channel to adhesively secure the first adhesive to the second adhesive. In a first embodiment, the second adhesive is covered with a protective tape which is removed prior to insertion of the sheets coated with the first adhesive on their binding edges. In such first embodiment, the sheets should be properly aligned prior to final adhesive securement of the first and second adhesive. In a second embodiment, the second adhesive is covered with a double layer of protective tape which may be removed by the user after insertion and alignment of the sheets. In the above binding covers, the front and back cover sheets may be previously joined to the spine member prior to insertion of the adhesive-coated sheets between said first and second cover sheets. Alternatively, the first and second cover sheets may be included as the extreme sheets which are clamped and coated with the first adhesive by said apparatus. In a further variation, the first and second cover sheets may be provided with ancillary pressure sensitive adhesive near the spine member, which pressure sensitive adhesive may be used for additional securement of the sheets after insertion in the spine member.

The invention also comprises a method for binding sheets within a binding cover comprising the steps of: aligning a plurality of sheets along binding edges thereof; clamping the sheets with binding edges aligned; coating the binding edges of said sheets with a first adhesive; inserting the adhesive coated binding edges of said sheets in a channel of a spline member, said spline member having a pressure sensitive adhesive within its channel; and adhesively securing said first adhesive to said pressure sensitive adhesive within said channel.

In a first embodiment of said method, first and second cover sheets are secured to said spline member prior to said inserting step, in which the sheets are inserted between the first and second covers. In a second embodiment of the method, the sheets which are aligned, clamped, and coated with said first adhesive include first and second cover sheets.

Preferably, a period of time is allowed to elapse between said coating step and said inserting step in order to permit the drying of said first adhesive coated on the binding edges of the sheets.

The invention also encompasses a binder for securing a stack of sheets coated along binding edges with a first adhesive, comprising an elongate, rigid spline member having a channel proportioned to receive and engage the binding edges of the stack of sheets, said spline member channel having a coating of pressure sensitive adhesive; and a protective tape covering the pressure sensitive adhesive and easily removable therefrom. Using such binder, the stack of sheets may be adhesively secured within the spline member channel by bonding the first adhesive and pressure sensitive adhesive after removing the protective tape. This binder may incorporate first and second sheets secured within the channel of the spline member.

In an advantageous embodiment of such binder the protective tape is folded against itself at a first end of the spline member to provide a lower layer removably adhered to the pressure sensitive adhesive, and an upper layer having a portion which protrudes from the end of the spline member opposite the first end.

The invention also provides a replacable adhesive applicator cartridge for use with binding apparatus of the type described above, comprising a supply of liquid adhesive; an applicator member; and a receptacle for the adhesive; wherein the receptacle is movable relative to the applicator member to expose the applicator member. Preferably, applicator cartridge comprises a foam pad.

In a perferred construction of the applicator cartridge, said applicator cartridge further includes an apertured cover to which the applicator member is secured. In this embodiment, the receptacle is slidably mounted within the cover and around the applicator member, and the telescoping of the receptacle relative to the cover exposes the applicator member through the aperture. The receptacle may include a cam to induce the movement of the receptacle relative to the cover by said binding apparatus. Advantageously, the receptacle carries a doctor blade or pin to skim excess adhesive from the applicator during the relevant motion of the receptacle and cover. The adhesive applicator cartridge may further include a support member which carries the applicator member and is secured to the cover. Such support member may include a reservoir for said adhesive, and apertures to permit the adhesive to flow between the applicator member and said reservoir.

In an alternative embodiment, a support housing for the applicator member is slidably mounted to the receptacle, and the telescoping of the receptacle relative to such support housing exposes the applicator member.

BRIEF DESCRIPTION OF THE DRAWINGS

The above and additional aspects of the invention are illustrated in the following detailed description of the preferred embodiments, to be taken in conjunction with the drawings in which;

FIGS. 16A, 16B are perspective views of an alternative applicator cartridge design, wherein FIG. 16A shows the applicator pad and support, and FIG. 16B the receptacle, of such cartridge.

DETAILED DESCRIPTION

Figure 1:
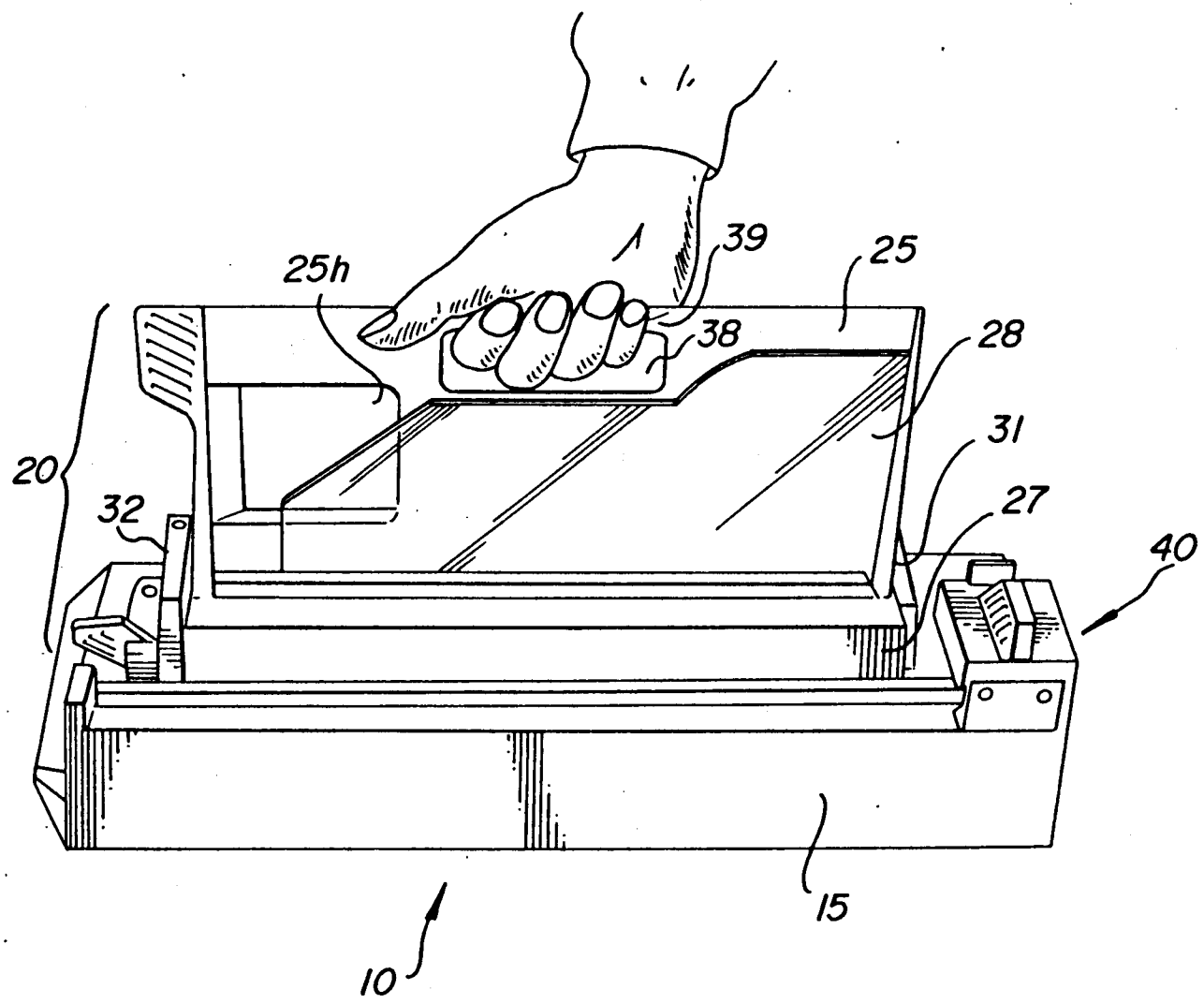
FIG. 1 is a perspective view of the apparatus of the invention illustrating the portable nature of the apparatus.

Referring now to FIGS. 1-7 and 14-15D, a binding machine 10 in accordance with the perferred embodiment of the invention includes as its principal subassemblies a clamping assembly 20 for receiving and aligning a plurality of sheets, and an adhesive applicator assembly 40 for coating aligned binding edges 85 of the sheets 80 with an adhesive 60.

Figure 2:
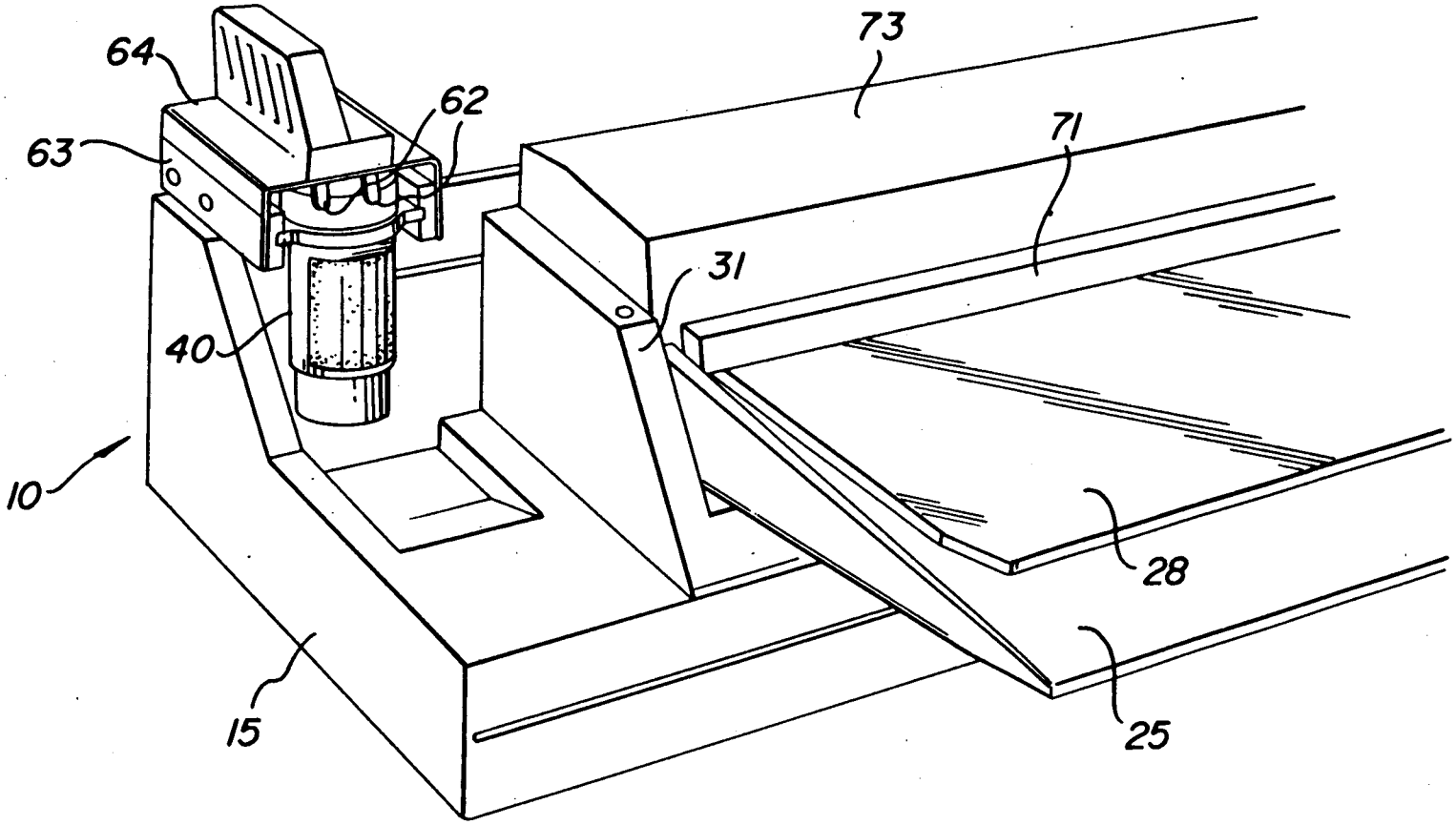
FIG. 2 is a partial perspective view of the apparatus of FIG. 1, showing the applicator cartridge and a portion of the clamping assembly as seen from the front of the apparatus.
Figure 4:
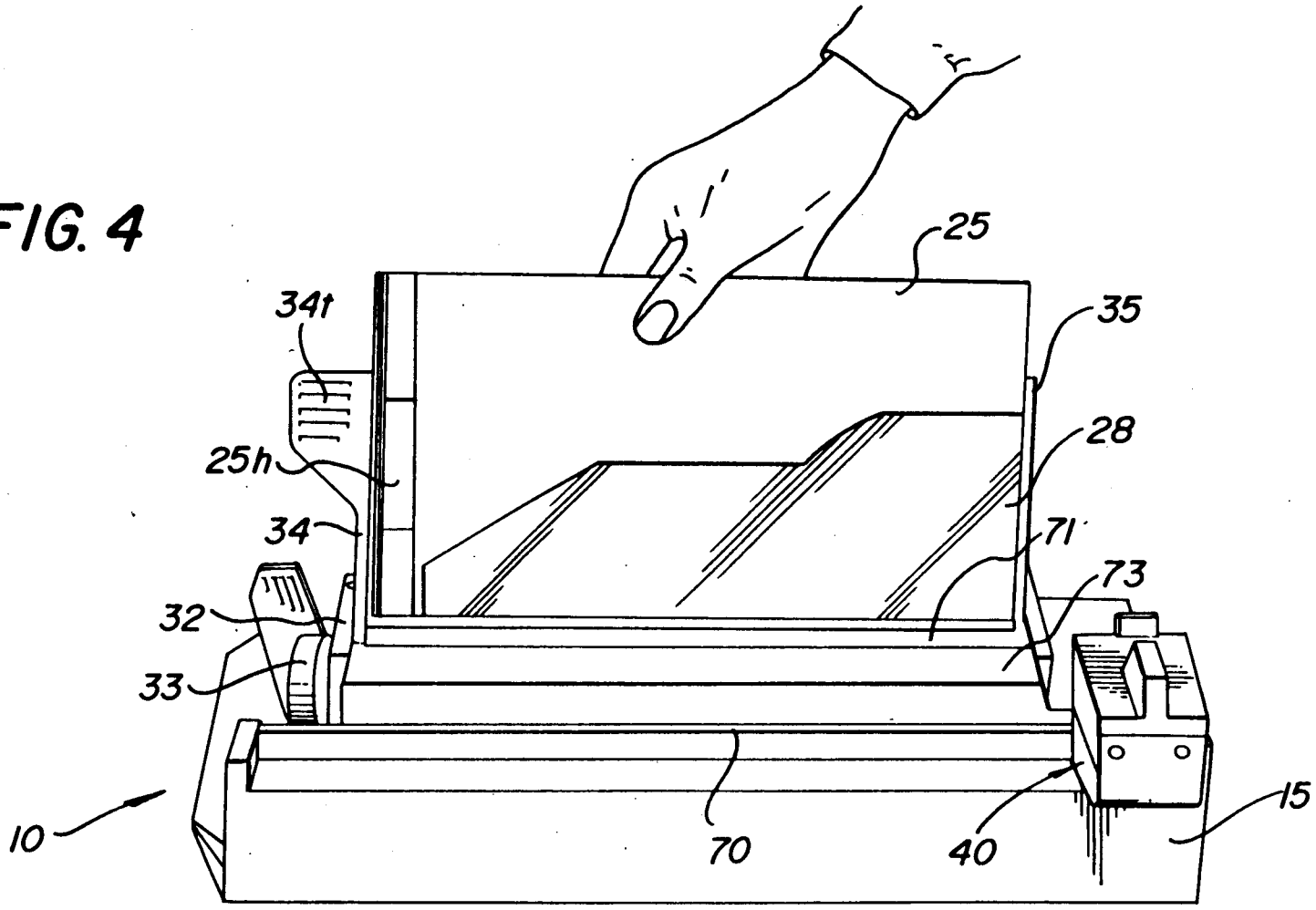
FIG. 4 is a perspective view of the apparatus of FIG. 1 seen from the rear with the clamping assembly in its upright position with inserted sheets.

As shown in FIGS. 2 and 4, the clamping assembly 20 includes a tray 25 and panel 28 supported by a support body 71 within cover 73, such tray being pivotally mounted in support walls 31, 32 which are part of a frame 15. The tray 25 and associated structures are pivotable between the position shown in FIG. 1 in which the tray and panel are substantially vertically oriented, and the position shown in FIG. 2 in which the structures are substantially horizontal. It will be seen in FIG. 1 that the vertical position of these structures provides a convenient configuration for carrying the machine 10 by means of the hand hold provided by the aperture 38 and handle 39.

The panel 28 is mounted so that it is oriented substantially parallel to the tray 25, the separation of tray 25 and panel 28 being adjustable by means of the knob 33. Having particular reference to FIGS. 5 and 6, rotation of the knob 33 causes the motion of the panel toward or away from the tray, so that sheets 80 may be inserted and clamped between these structures. In the position shown in FIG. 5, panel 28 is at a position of maximum separation from tray 25 permitting the insertion of a plurality of sheets 80 to be bound. In this position the sheets may be squared by aligning the vertical edges of the sheets against the ledge 35. As seen in FIG. 4 the sheets may be conveniently aligned against ledge 35 since the tray 25 includes a hollow 25h adjacent the ledge 34 providing a convenient finger hold. In addition, at this position the bottom edges of the sheets (which eventually serve as the binding edges 85) are aligned against a stacking surface 36 (FIG. 14A) provided by a flat, depressed area of the frame between the walls 31, 32. Frame 15 and the bottom of tray 25 may be provided with magnetic strips (one seen at 16 in FIG. 14A) to hold the tray in its upright orientation.

Figure 5:
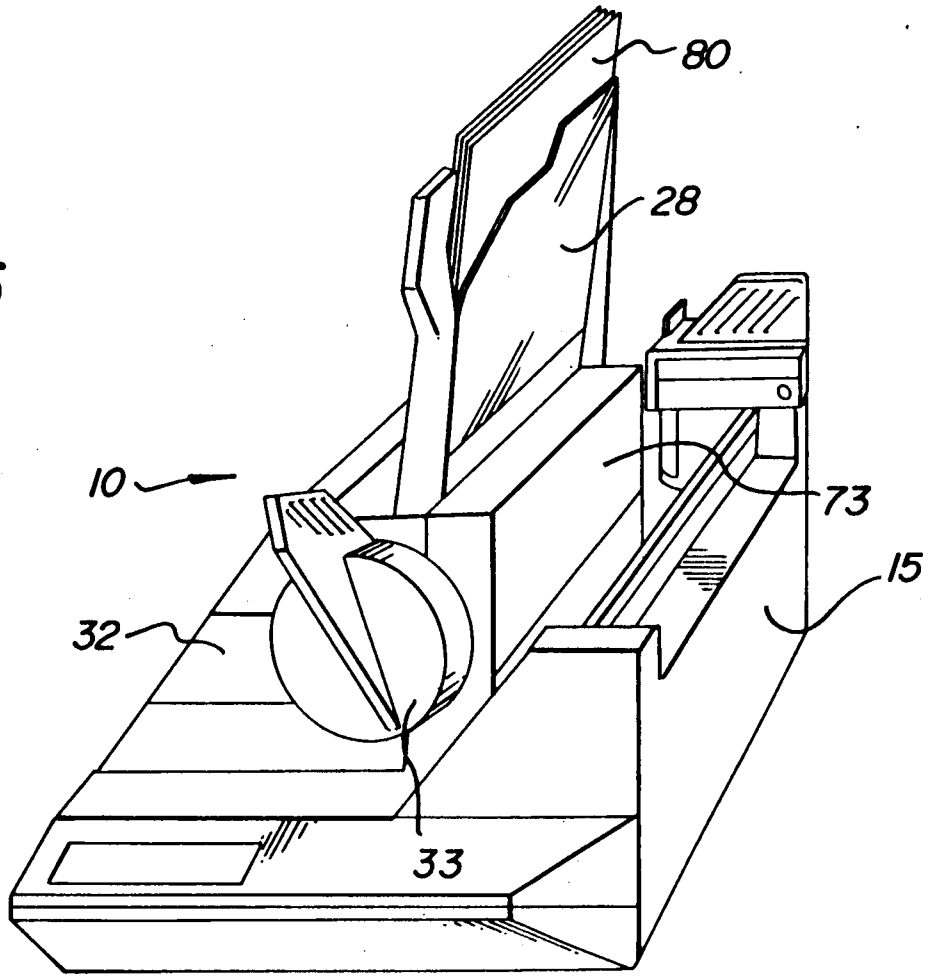
FIG. 5 is a perspective view of the apparatus of FIG. 1 as seen from one side showing the clamping assembly in its upright position.
Figure 6:
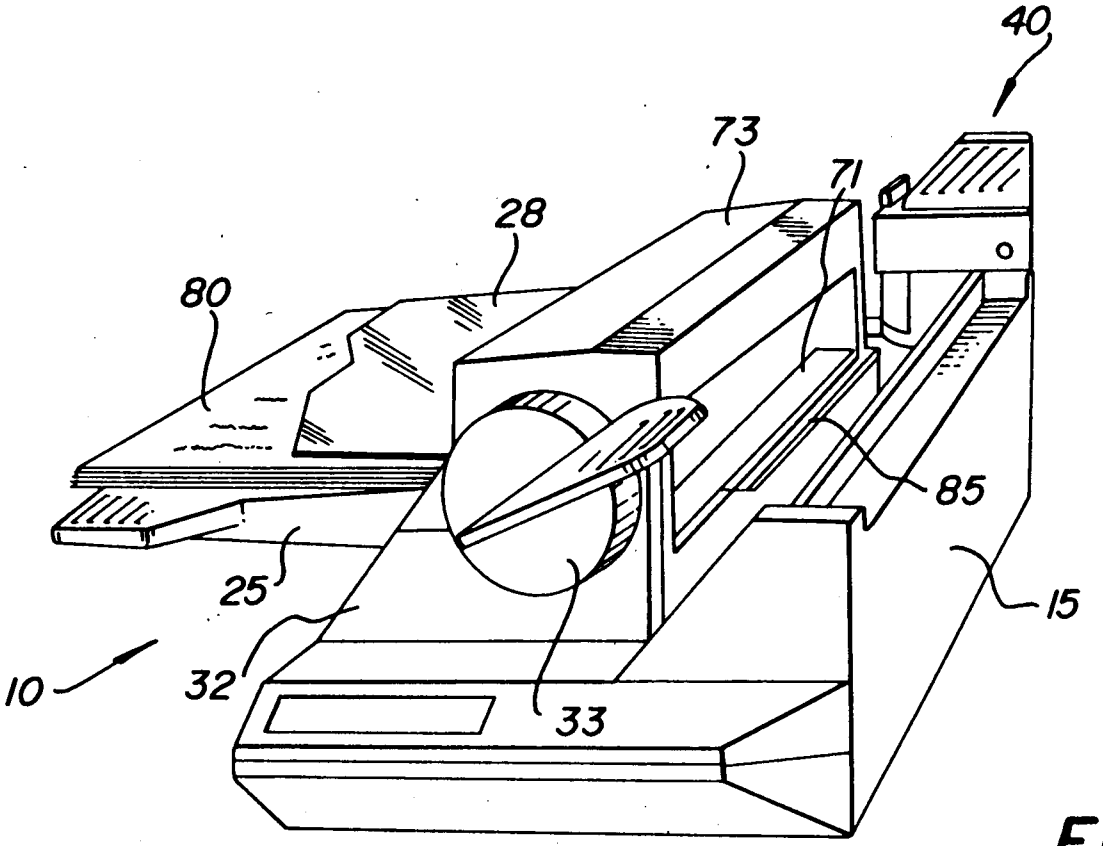
FIG. 6 is a perspective view of the apparatus corresponding to the view of FIG. 5 with the clamping assembly in its horizontal position and the inserted sheets clamped and ready for coating with adhesive.

Referring again to FIGS. 5 and 6 after inserting and squaring the sheets 80 user turns the knob 33 clockwise in order to bring panel 28 toward tray 25 causing the panel 28 to clamp sheets 80 against tray 25 (FIG. 6). The user may then grasp the tab 34t and swing the tray 25 and structures carried thereon into a horizontal orientation. As seen in FIG. 14A the frame 15 carries a bumper 19 to cushion and limit the pivotting of the tray. In this position the binding edges 85 of sheets 80 protrude through the opening 27h in housing 27 where binding edges 85 may be coated with adhesive as described below (FIG. 6).

Figure 14:
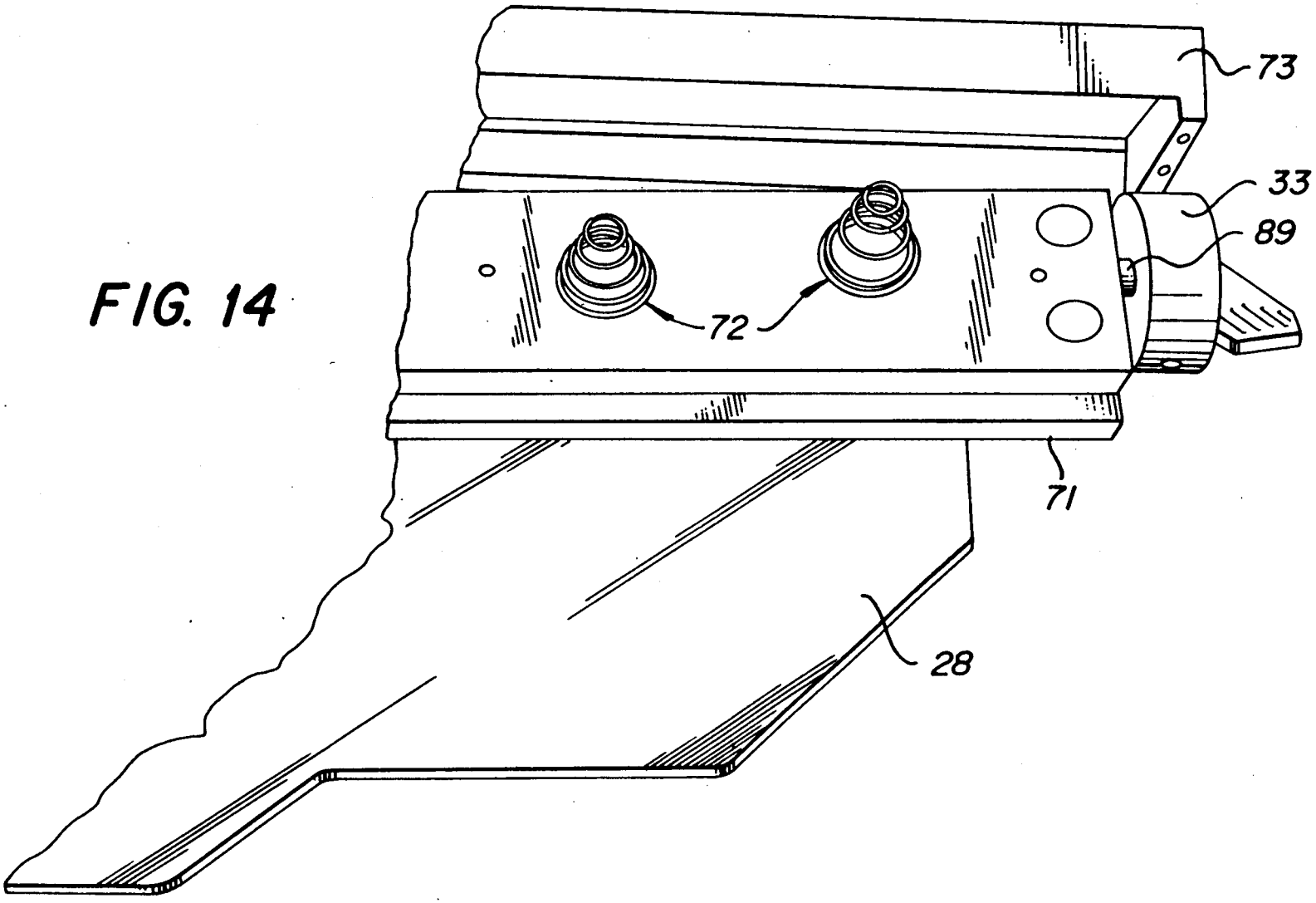
FIG. 14 is a perspective view of the apparatus with the lid of the clamping assembly removed to show the internal mechanisms of said assembly.
Figure 14A:
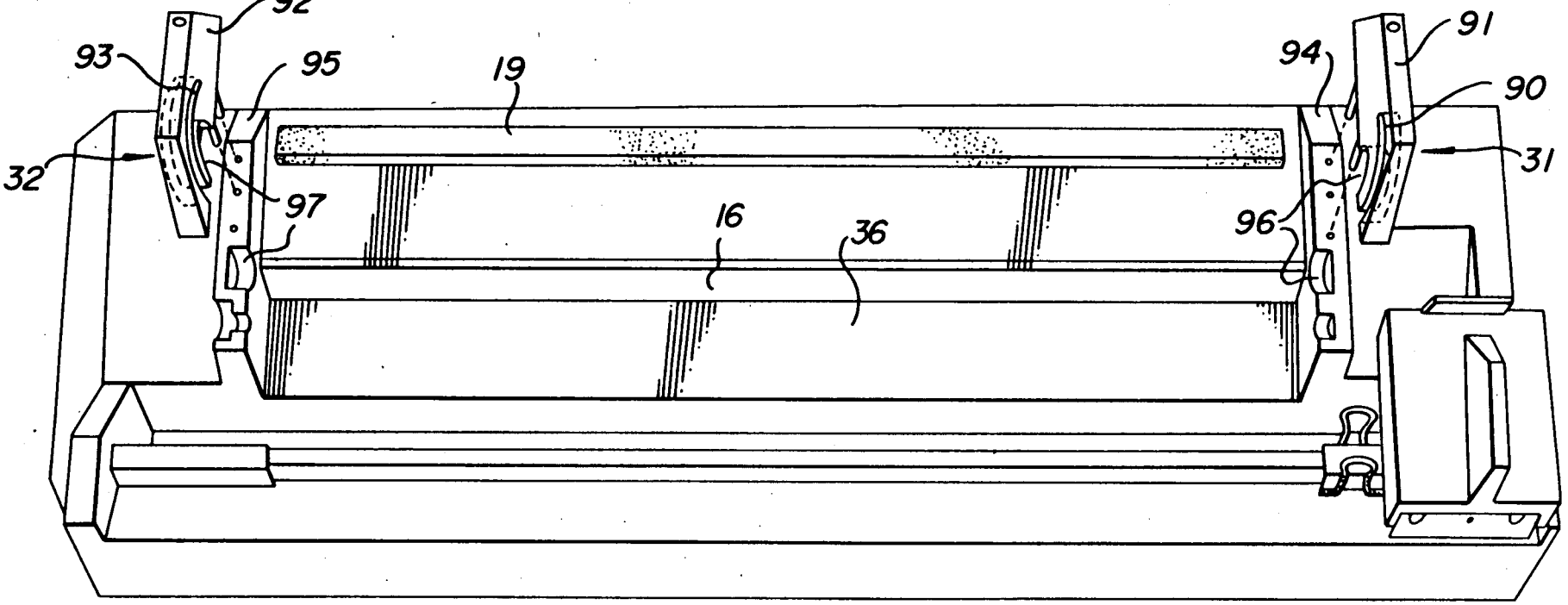
FIG. 14A is a partial perspective view of the frame as seen from the rear with the tray, panel, and panel housing removed.
Figure 14B:
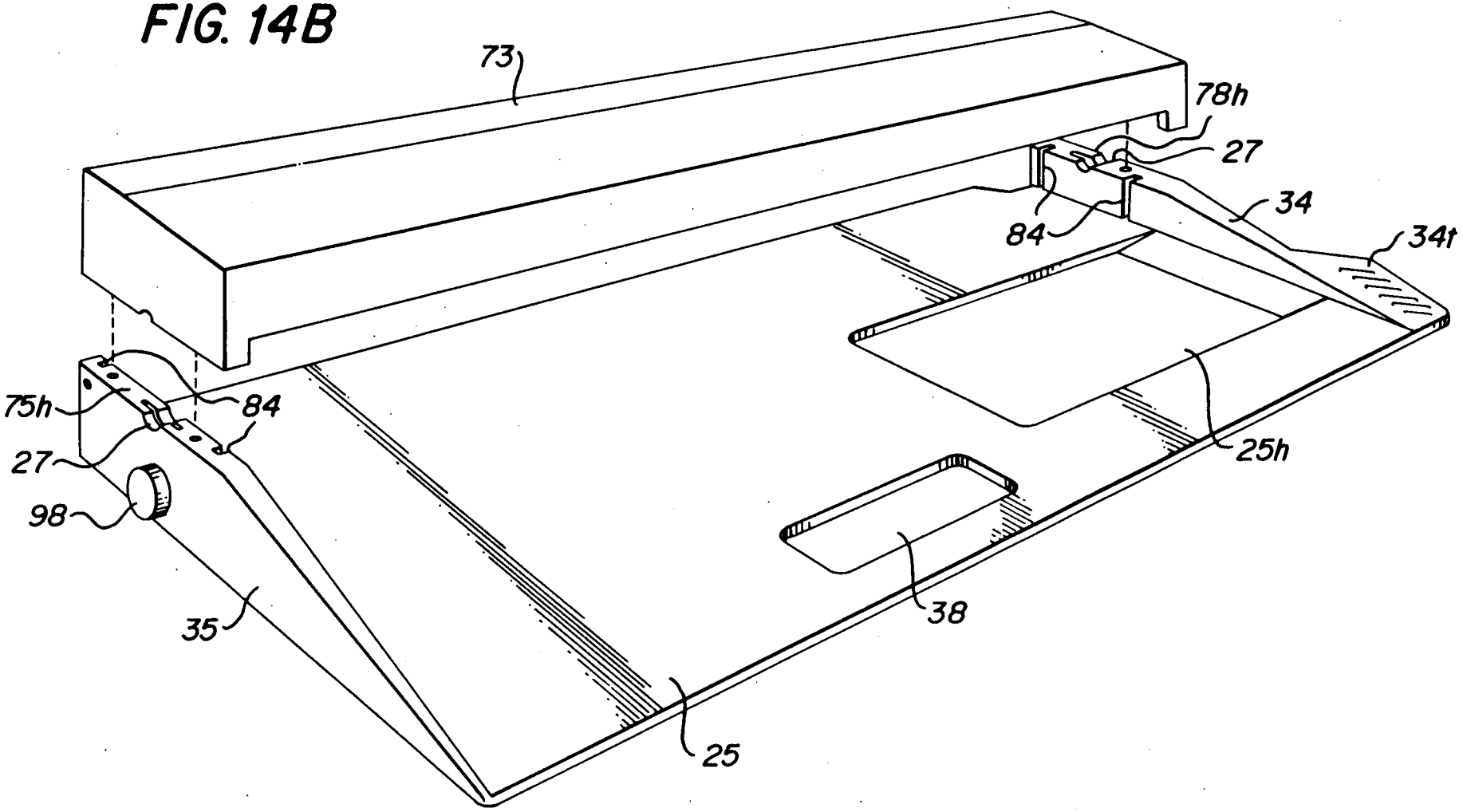
FIG. 14B shows in perspective the housing cover removed from the tray to illustrate the interface of these structures.
Figure 14C:
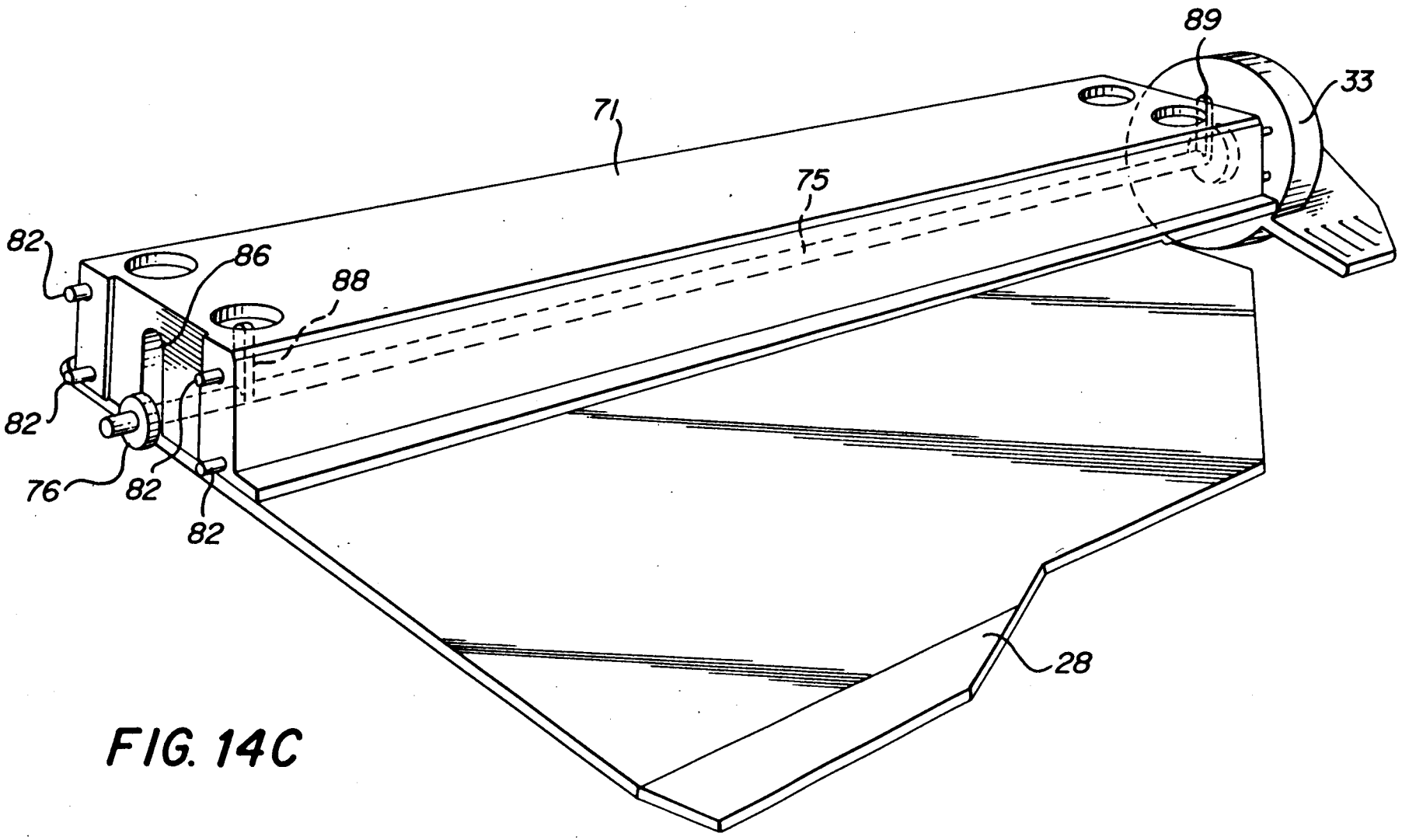
FIG. 14C is a perspective view of the panel, panel support body and rod showing in phantom the cam structures of the rod.

Reference should now be had to FIGS. 14, 14A, 14B and 14C for an explanation of the mechanisms of clamping assembly 20. The panel 28 is secured to support body 71, such support body being located between the tray 25 and housing cover 73. A rod 75 is rotatably mounted in openings 27 defined by the ledges 34, 35 and cover 73, such rod being fitted at one end with the knob 33. A disk 76 near one end of rod 75 seats within groove 75h in ledge 35 and cover 73, while an arm 89 fixed to the rod near knob 33 may move within a hollow 78h in ledge 34 and cover 73. This arrangement prevents sliding but permits rotation of the rod via handle 33. The panel support body 71 is slidably mounted within cover 73 and panel 25 by virtue of eight metal pins 82 (four of which are seen in FIG. 14C) extending from body 71; pins 82 slide within grooves 84 in cover 73 and tray 25 (only the grooves in tray 25 are visible in FIG. 14B). Rod 75 extends through body 71 to permit relative vertical movement within a vertical slot 86 at one end of body 71. Rod 75 carries cam arms 88, 89 (shown in phantom in FIG. 14C) which respectively press up against the upper wall of body 71 and the top of a hollow 78h in cover 73, respectively, when the knob 33 is in its counterclockwise position (FIG. 5). In this position the cams overcome the downward bias on body 71 induced by springs 72 (FIG. 14). When the user turns knob 33 clockwise the rotation of cams 88, 89 permits the lowering and clamping of support 71 and panel 28 against tray 25 (and any inserted sheets 80).

As best seen in FIG. 14A, the walls 31, 32 advantageously include removable upper portions 91, 92 as well as base portions 94, 95 which are integral with frame 15. Wall 31 defines a cylindrical cavity 96, and wall 32 defines cylindrical cavity 97. Cavities 96, 97 capture cylindrical plugs 98 (one seen in FIG. 14B) on the ends of tray 25. Wall 31 includes arcuate groove 90 in which one end of the rod 75 may slide, while wall 32 includes slot 93 through which the other end of rod 75 extends. This arrangement permits the rotation of tray 25 and housing 27 relative to walls 31, 32.

Figure 7:
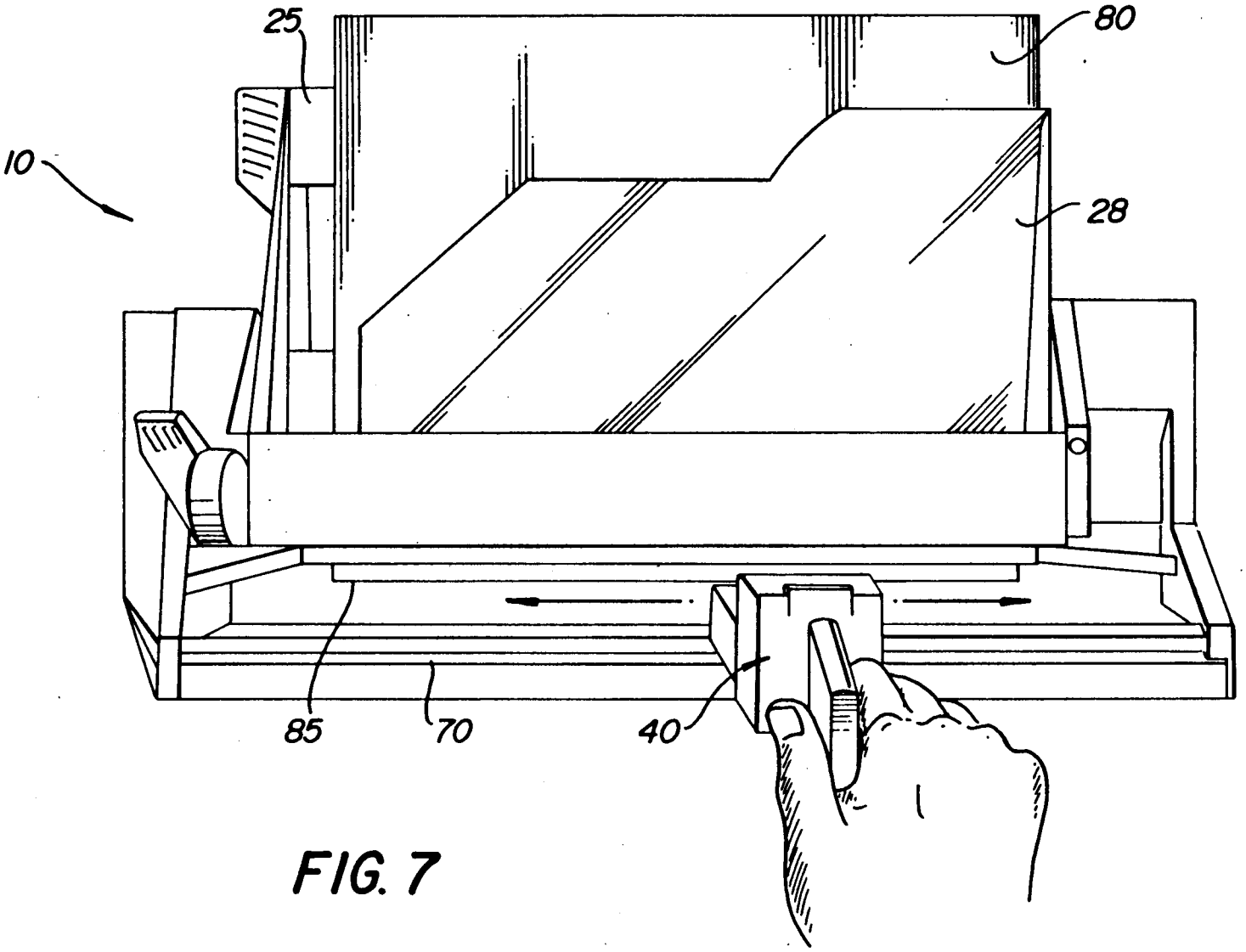
FIG. 7 is a top perspective view of the apparatus of the invention showing the sliding of the applicator cartridge for coating the binding edges of the sheets with adhesive.
Figure 8:
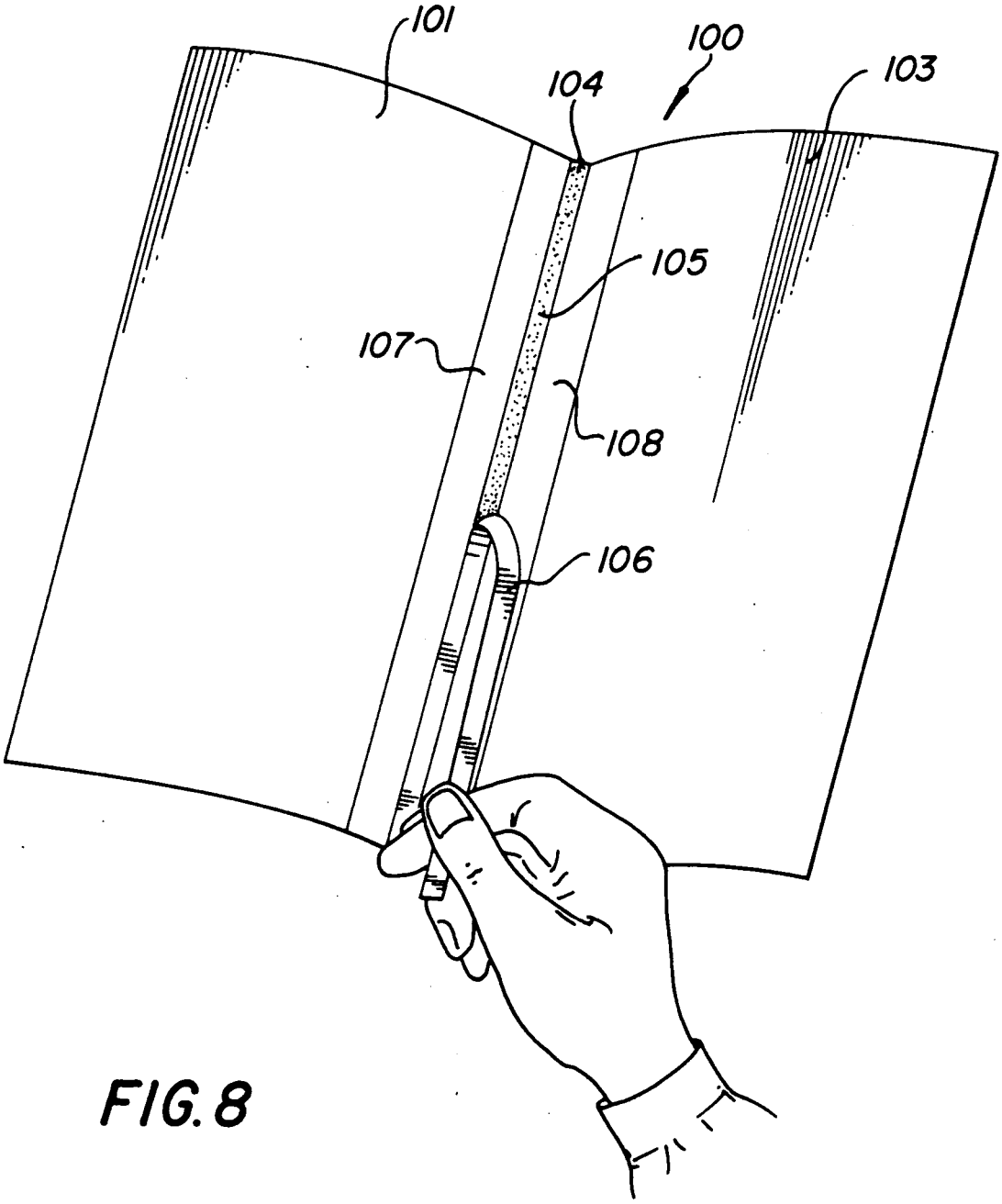
FIG. 8 is a perspective view of a binding cover in accordance with the first embodiment of the invention, showing the removal of the cover tape for the adhesive within the channel.

As shown particularly in FIGS. 2-4 and 7 the assembly for coating the binding edges 85 with adhesive includes a removable adhesive applicator cartridge 40 and housing structures for the cartridge which are slidable along a track 70 at the rear of the frame 15 (FIG. 7). The cartridge 40 is shown in FIGS. 15, 15A-15D, and includes a cover 42 of substantially cylindrical form having a window 43, and a cup 55 slidably mounted within cover 42. As seen in FIGS. 15A, 15C showing cartridge 40 from the rear, cover 42 includes a groove 46 in which a pin 48 secured to cup 55 is journaled to guide the telescoping of cup 55 relative to cover 42. The cup 55 also has a button 57 as seen in FIGS. 15A, 15C, the purpose of which is explained below.

Figure 15B:
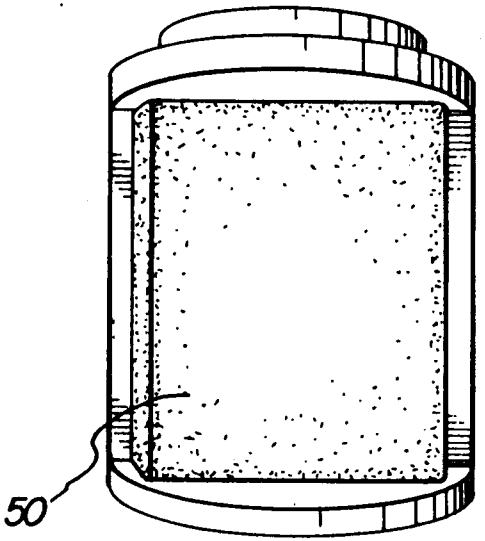
FIG. 15B is a cutaway view of the adhesive cartridge of FIG. 15, showing the applicator pad
Figure 15A:
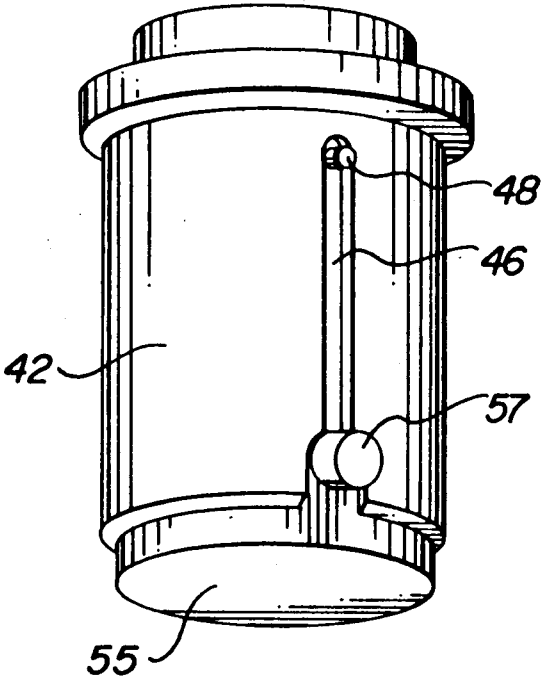
FIG. 15A is a rear perspective view of the adhesive cartridge of FIG. 15.
Figure 15:
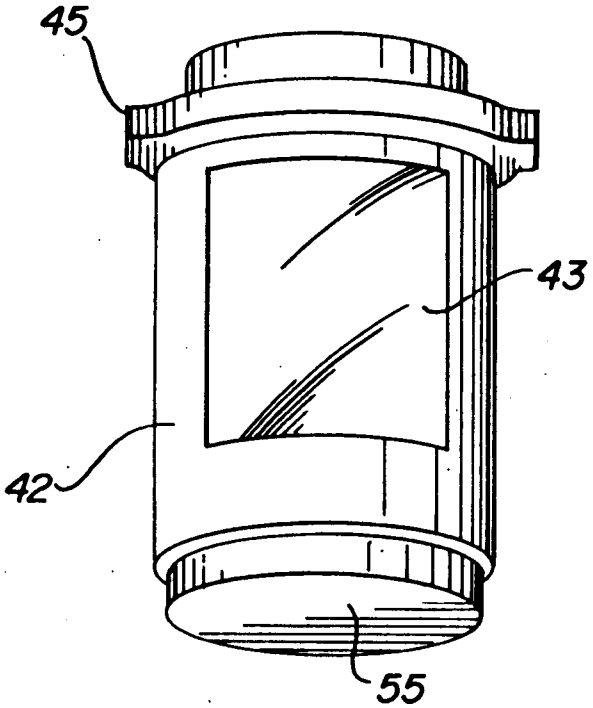
FIG. 15 is a front perspective view of the adhesive cartridge from the apparatus of FIGS. 1–7.
Figure 15C:
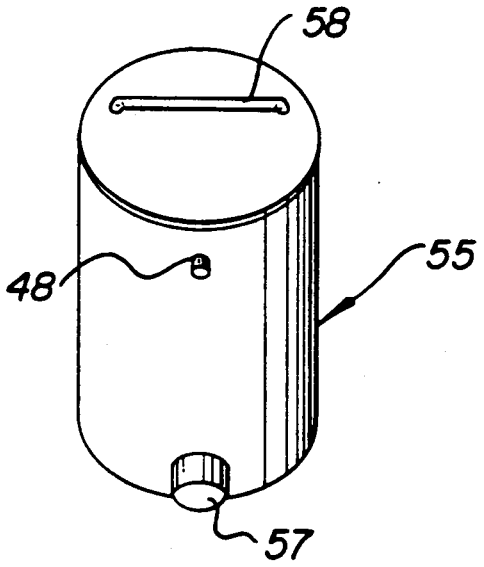
FIG. 15C is a rear perspective view of the cup from the adhesive cartridge of FIG. 15.
Figure 15D:
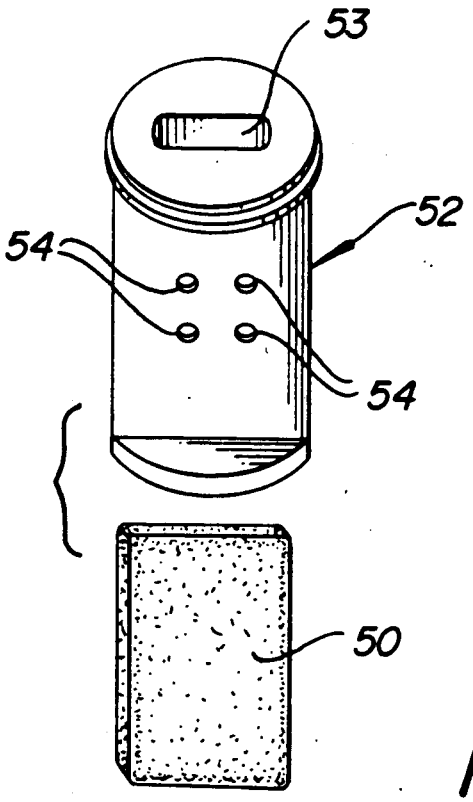
FIG. 15D is a front perspective view of the support post and applicator pad from the adhesive cartridge of FIG. 15, showing these structures separated.

As seen in FIGS. 15B, 15C and 15D which illustrate the internal structures of the applicator cartridge 40, cover 42 and cup 55 surround a foam applicator pad 50 which is supported by a post 52 suspended from the top of cover 42. Cup 55 contains a supply of adhesive 60 which wets the foam pad 50 when cup 55 is fully retracted. Post 52 includes an internal reservoir 53 for holding adhesive 60, which reservoir communicates with the foam pad 50 via holes 54 in post 52. The telescoping of cup 55 causes foam pad 50 to be exposed through the window 43 in cover 42 (FIG. 3A). As shown in FIG. 15C cup 55 carries a doctor pin 58 which skims excess adhesive off foam pad 50 during the telescoping of cup 55. Cover 42 also includes an O-ring (not shown) providing a seal between the cup 55 and cover 42 when the former is retracted into the latter.

Figure 3:
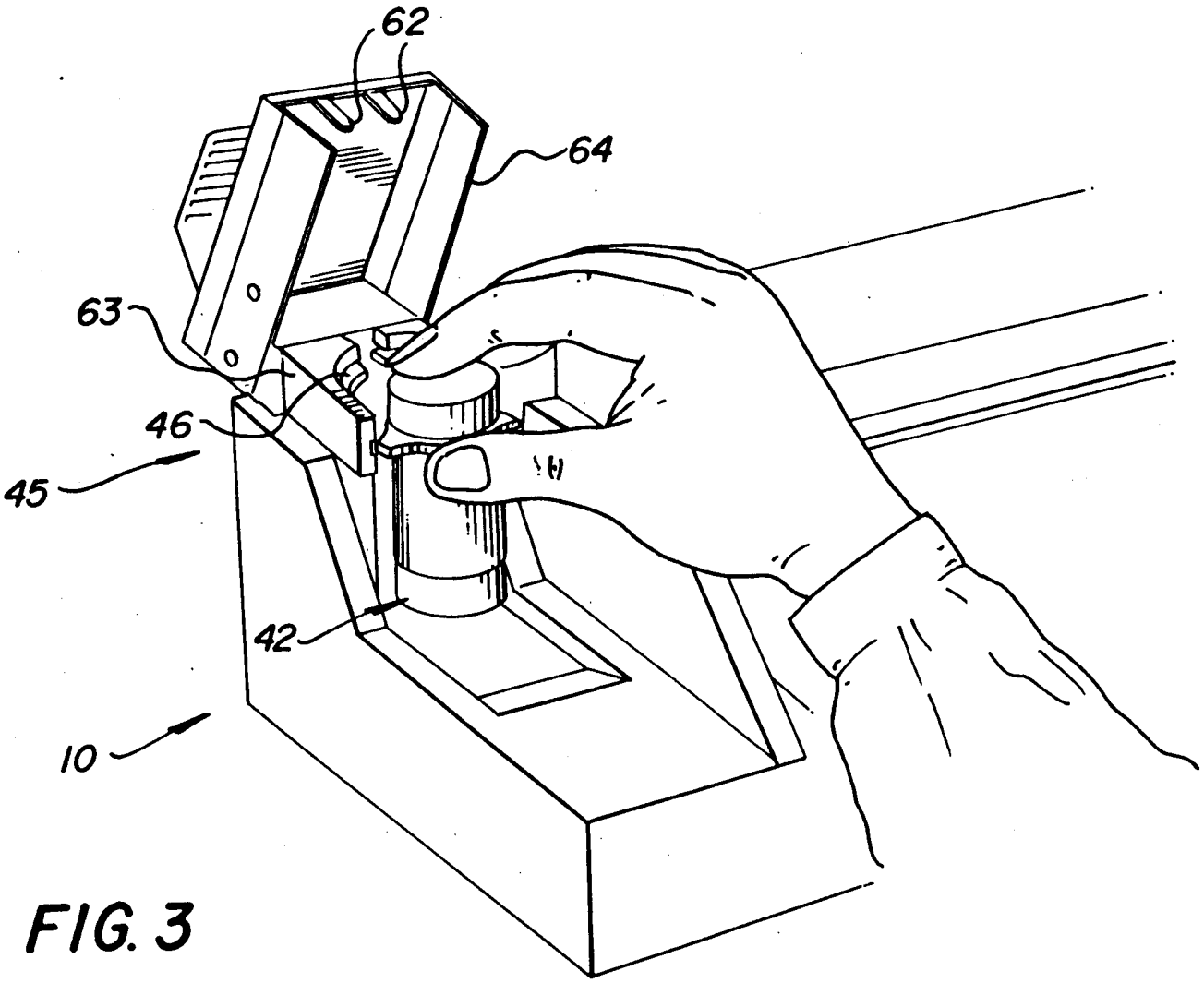
FIG. 3 is a perspective view of the apparatus of FIG. 1, showing the removability of the applicator cartridge.
Figure 3A:
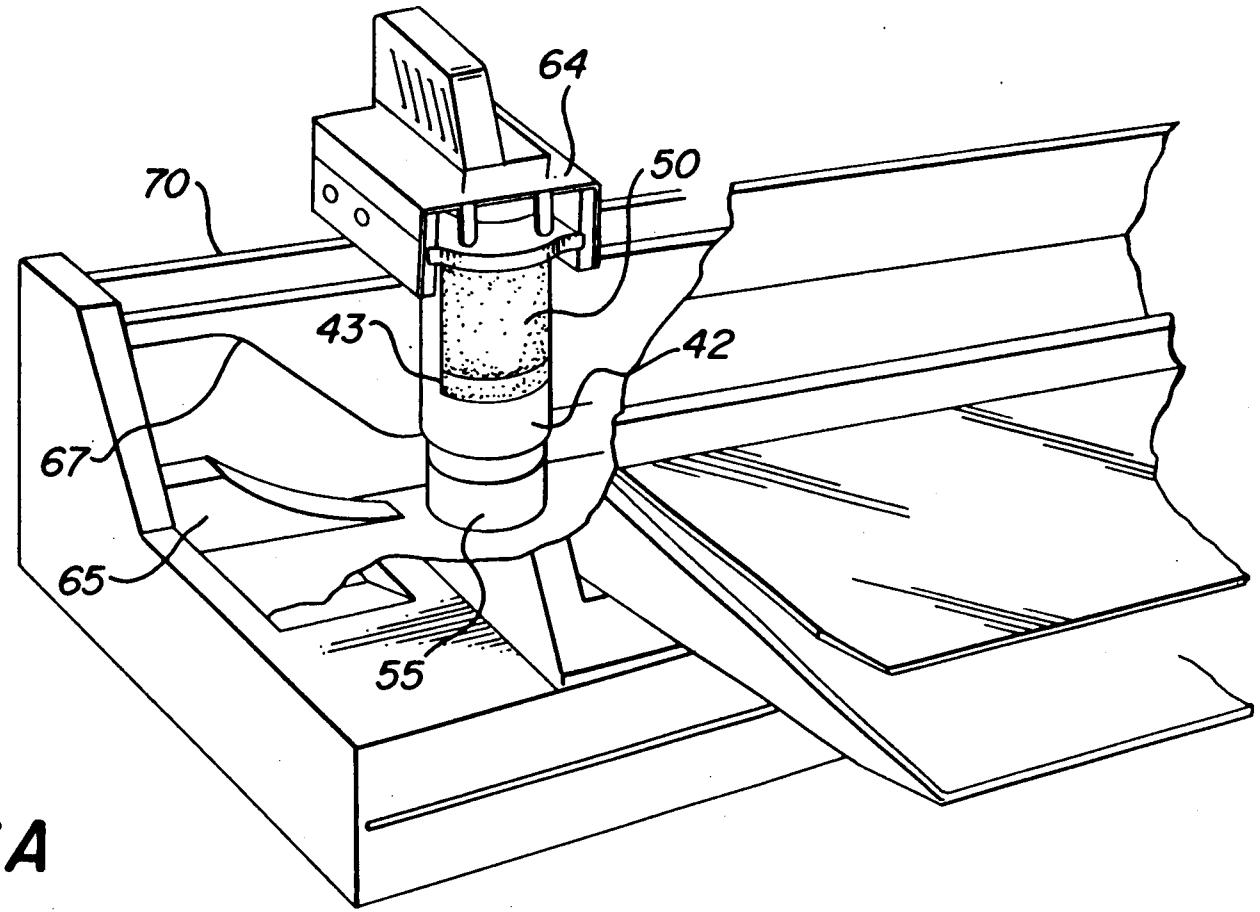
FIG. 3A is a perspective view of the apparatus partially cutting away the clamping assembly to show the sliding of the applicator cartridge and cam mechanisms associated therewith.

Now having reference to FIG. 3, adhesive applicator cartridge 40 is mounted within a cartridge housing which includes housing portion 63 and lid 64 which is pivotally mounted to portion 63. As seen for example in FIG. 3, the cover 42 of cartridge 40 includes an annular flange 45 which mates with annular groove 46 in cartridge housing 63. Upon lifting lid 64, cartridge 40 may be slidingly removed when the adhesive in the cartridge is spent (FIG. 3), and a new cartridge may be inserted.

Lid 64 includes pegs 62 which help to retain the applicator cartridge 40.

Referring to FIGS. 15A and 3A, the button 57 at the rear of cup 55 slides against a cam surface 67 at the rear inner wall of the frame 15 (FIG. 3A). This camcam follower arrangement causes the downward projection of the cup 55 and the exposure of foam pad 50 through window 43 as the cartridge assembly 40 is moved away from its home position for coating the binding edges 85 of sheets with adhesive (see also FIG. 7). Furthermore, frame 15 includes a wedge 65 at the "home" position of applicator cartridge assembly 40. Wedge 65 forces cup 55 to close and seal when cartridge 40 is returned to its home position.

Figure 16A:
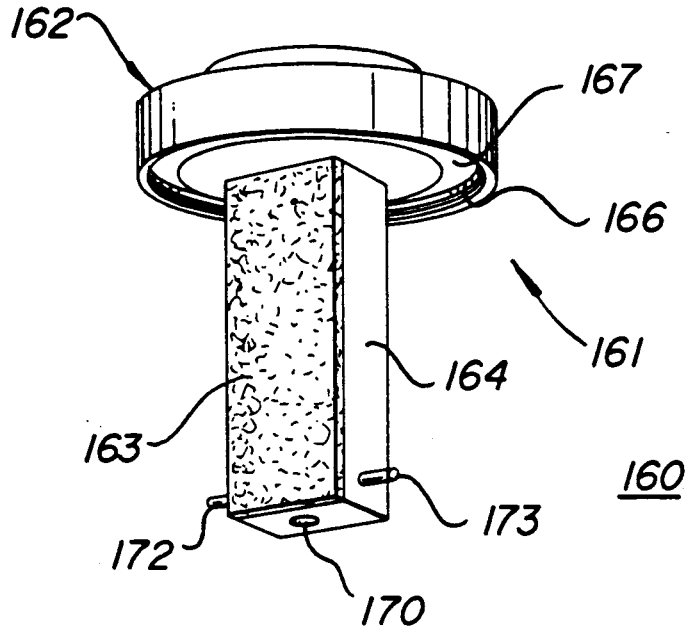
Figure 16B:
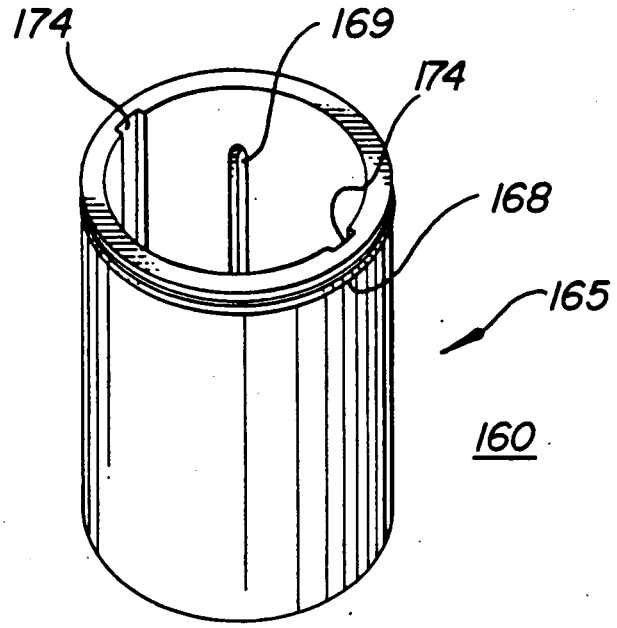

An alternative adhesive applicator cartridge 160 is shown in the perspective views of FIGS. 16A, 16B (which are taken from different perspectives to better show the salient features). Cartridge 160 consists of a support structure 161 for the adhesive applicator pad 163, and a receptacle 165 in which the support 161 and applicator pad 163 are slidably mounted. Support 161 includes a cap 162 which has interior screw threads 166 which mate with complementary threads 168 at the upper exterior of receptacle 165, whereby the applicator and support may be screwed into place and sealed after use, and may be unscrewed in preparation for use. Support 161 also includes a post 164 for holding applicator pad 163. Cap 162 is rotatably mounted around post 164 and contains an O-ring 167 for sealing against the lip of receptacle 165 when the support 161 is screwed shut. The sliding of the support 161 within receptacle 165 is guided by a rod 169 projecting from the base of receptacle 165, which slides within a groove 170 in post 161; and by pins 172, 173 laterally projecting from post 164, which slide within grooves 174 in the inner wall of receptacle 165. This cartridge omits the separate, apertured cover of the principal embodiment and the receptacle serves in effect as part of the cover.

Applicant has observed that the sliding of applicator assembly 40 back and forth once across binding edges 85 effectively coats the binding edges 85 of a stack of sheets 80 with adhesive. If the initial coating is uneven this process may be repeated. In an alternative embodiment not shown in the drawings, the sliding of the applicator cartridge and the coating of the clamped sheets are automated using a motor-driven transport. Once coating of edges 85 with adhesive 60 is completed, the user waits for a suitable period of time (typically on the order of half a minute to a minute) for the adhesive to dry prior to removal of the sheet 80 from apparatus 10. The sheets may be used in that form (so-called "padding of sheets") or the binding edges 85 may be reinforced. Binders for reinforcing binding edges 85 are described below after discussion of the adhesive 60.

One of the principal advantages of this binding method is the ability to prepare multiple reports with a single use of the clamping and adhesive coating machine 10. Thus, various reports can be stacked in sequence and their binding edges coated with adhesive. Later, these reports can be separated to be used as is, or to be separately bound.

Although a variety of adhesives 60 for coating the binding edges 85 are usable, it is desirable to utilize a quick-setting water base adhesive which has the property that it quickly sets in less than about a minute when it contacts a stack of paper sheets while exposed to the environment. The so called quick drying adhesives are most preferred since they reduce the time the user waits after coating the binding edges 85 to extract the paper 80 from the machine. Thus, it is preferable to use a quick drying water based adhesive which has a setting time of less than about 1 minute.

A preferred adhesive for the adhesive 60 in the aforementioned embodiment of the invention is a quick drying polyurethane water based adhesive. This preferred adhesive has the property that it sets in less than about 1 minute, typically within about 30 to 40 seconds, when simultaneously exposed to the environment and applied to an edge of a stack of paper sheets. The adhesive has the property that it provides a very strong bond which holds the stack of sheets firmly and permanently bonded either in pad form or in the channel-bound forms described below.

A preferred polyurethane water based quick drying adhesive for use in the present invention has the component formulation shown in Table I.

The polyurethane water based adhesive having the component formulation shown in Table I may be prepared in the following three stages:

1. Prepolymer Formulation

The macroglycol (b), acid-functional diol (c), and the diisocyanate (a) (the diisocyanate in stoichiometric excess) are initially coreacted in the presence of the stannous octoate catalyst (e) at reaction temperature.

The acid groups of the acid functional diol are believed to be preserved throughout this reaction.

2. Coemulsification of Isocyanate—Functional Prepolymer and Low MW Resinous Compound The prepolymer product of step (1) is blended at ambient temperatures with the stated amount of the low MW resinous compound (g) which was previously dissolved in isopropanol The blend is further introduced to an agitating mixture of deionized water (h) and triethylamine at ambient temperature. A smooth low particle size emulsion is rapidly formed during agitation.

3. Chain-Extension of Emulsified Prepolymer

Immediately after a complete and uniform emulsion is formed in step (2), the percent by weight shown in Table I of the aliphatic diamine (d) is added to the aqueous

TABLE I

| Polyurethane Adhesive Component Formulation | Percent By Weight |
|---|---|
| a. aliphatic diisocyanate (e.g., isophorone diisocyanate from Huls Corporation.) | 5.8 |
| b. poly(propylene oxide) macroglycol (e.g., 2000 MW poly(propylene oxide macroglycol available from Union Carbide Corp. under 2025 macroglycol) | 19.4 |
| c. acid functional diol (e.g., dimethylolpropionic acid available from the IMC division of Pitman-Moore Co.) | 1.0 |
| d. aliphatic diamine chain extender (e.g., ethylene diamine) | 0.4 |
| e. organotin catalyst (e.g., stannous octoate catalyst available under the tradename T-9 catalyst from Air Products Co.) | 0.005 |
| f. tertiary amine counterion (e.g., triethylamine) | 0.8 |

TABLE I-continued

| Polyurethane Adhesive Component Formulation | Percent By Weight |
|---|---|
| g. low M.W. resinous component alcohol soluble (e.g., styrene allyl alcohol resin available under the tradename RJ-100 from Monsanto Corp.) | 13.3 |
| h. deionized water | 45.9 |
| i. alcohol (e.g., isopropanol) | 13.3 |
| | 100.0 |

system. This causes rapid reaction which forms urea linkage within the formed polyurethane polymer particles resulting in the production of the quick drying polyurethane water based adhesive for use in the bindable cover folders of the present invention. This adhesive sets in less than about one minute when exposed to the environment in contact with a stack of paper sheets.

Various binder constructions for use with the above-discussed binding apparatus 10 are shown in FIGS. 8–13. Having reference to FIG. 8, binder 100 includes first and second cover sheets 101, 103 secured to a binder spline 104. Cover sheets 101, 103 may be formed from a single sheet which is folded for bonding to the binder spline 104, and preferably scored along the longitudinal edges of spline 104 to facilitate folding in use. Member 104 has a coating 105 of pressure sensitive adhesive which may be exposed by removal of protective tape 106. A stack of sheets 80 previously coated with adhesive 60 at their binding edges 85 may be aligned with the spine member 104 and the adhesive 60 then pressed against adhesive 105 to secure the sheets to the spine member 104, which provides structural support. Cover sheets 101, 103 may be provided with release strips 107, 108 adjacent binder spline 104 which may be wiped free of any stray adhesive 60 left after binding the sheets 80.

Advantageously, as better illustrated in views of a further embodiment (FIG. 11A), a binder spline 144 is an elongated rigid member formed of a flat back panel 144C and flat or substantially flat top and bottom panels 144A and 144B, respectively which emanate from back panel 144C. Panels 144A, 144B, and 144C define a channel 144D for retaining the edges of sheets to be bound. Panels 144A, 144B are oppositely facing and coextensive. Panels 144A, 144B may be parallel, or may be slanted towards each other at their free edges. Binder spline 144 is preferably formed in one step by extruding a suitable thermoplastic material, for example polystyrene, polyethylene, polypropylene, ABS acrylonitrile or butadiene styrene.

Referring again to FIG. 8, pressure sensitive adhesive 105 is a coating or tape mounted in the channel of spline 104, advantageously of a high tack in conjunction with the adhesive coating of binding edges 85. In an operative embodiment of the invention the adhesive 105 consisted of 11411 Sticky Pack TM pressure sensitive two sided adhesive tape of Minnesota Mining and Manufacturing Co., St. Paul, Minn.

Figure 9:
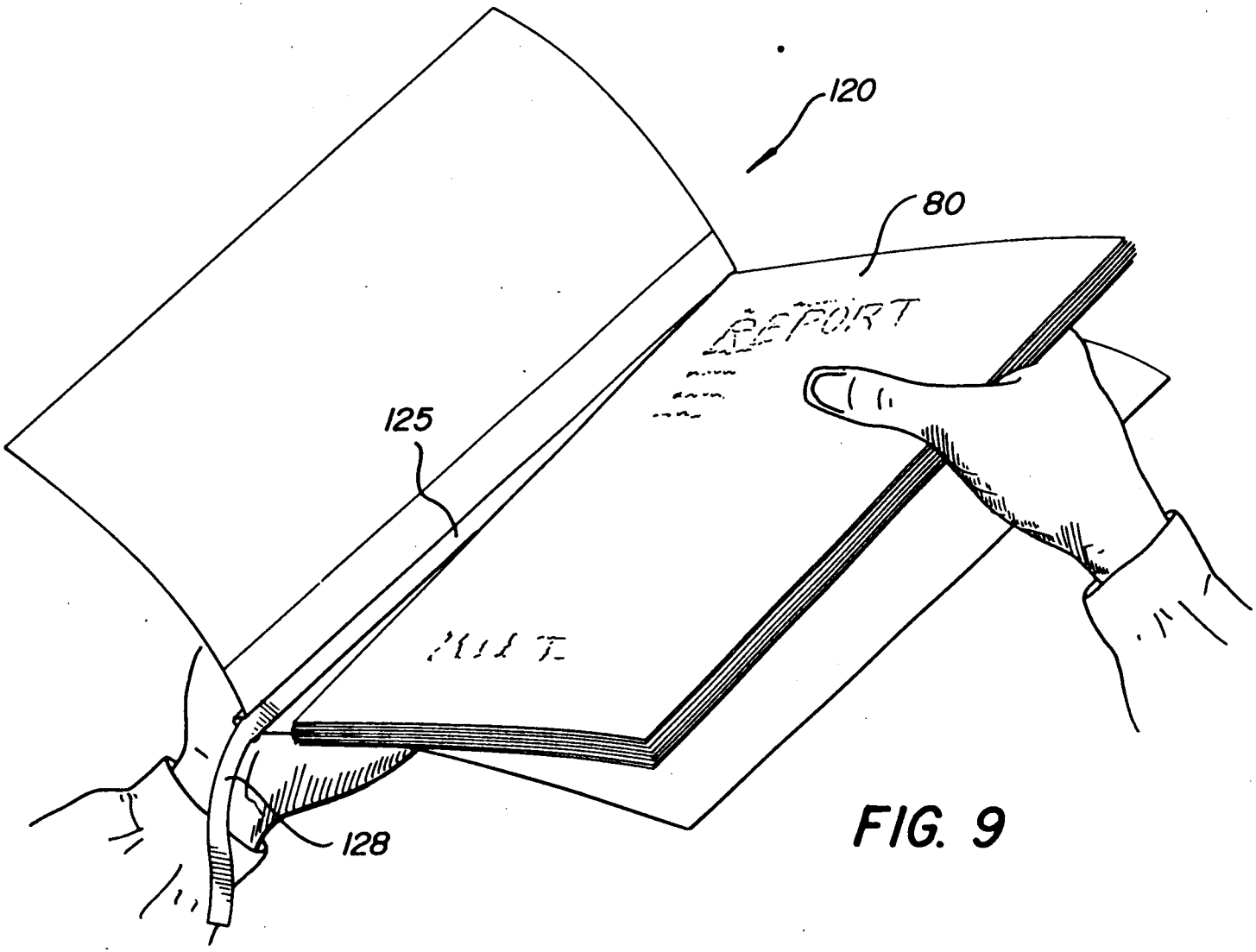
FIG. 9 is a perspective view of a binding cover in accordance with a second embodiment of the invention, showing the insertion of sheets to be aligned.
Figure 10:
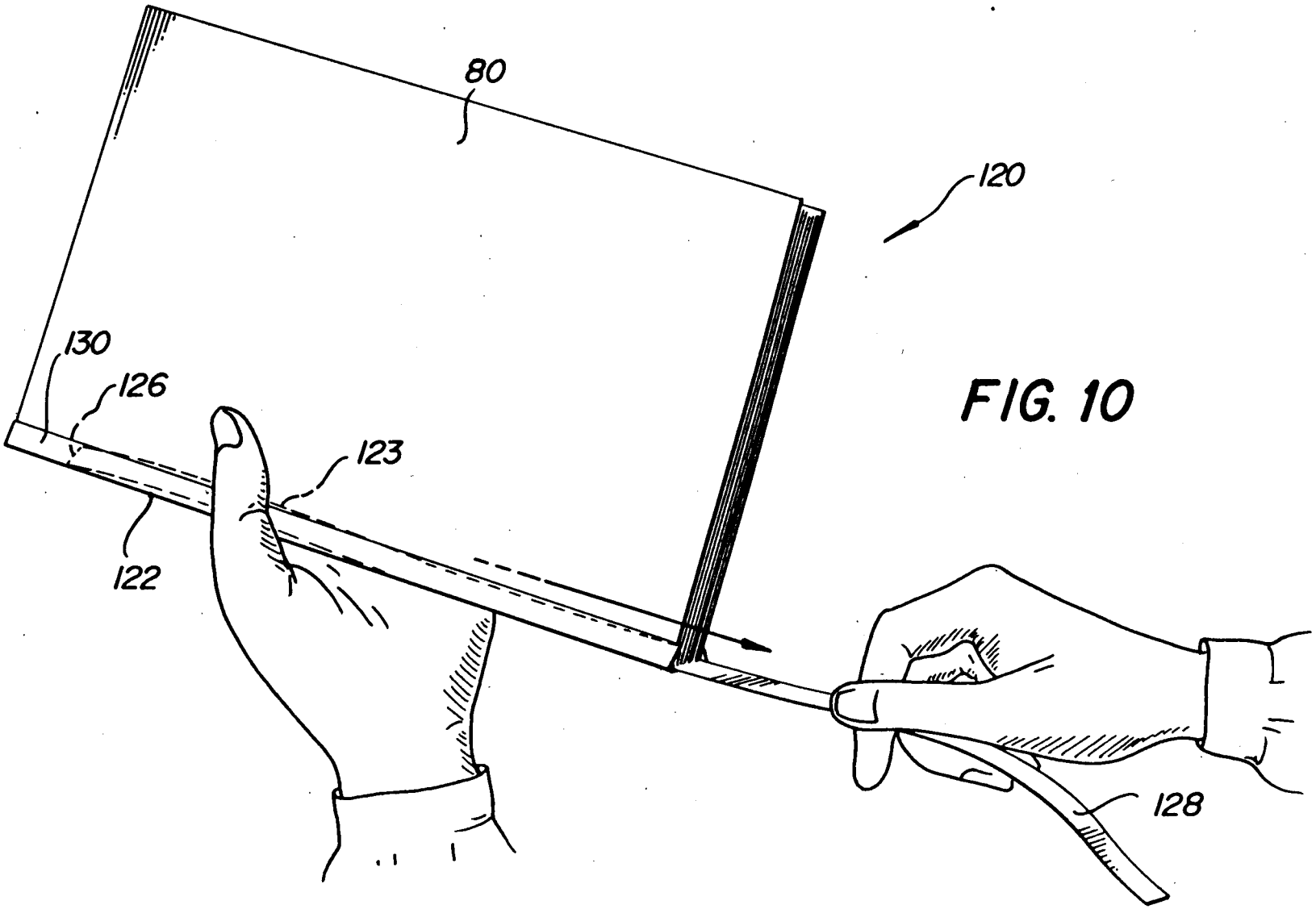
FIG. 10 is a perspective view of the binding cover of FIG. 9 with sheets aligned showing the removal of the double-layer cover tape.

FIGS. 9 and 10 illustrate a second binder 120 which is designed so that sheets 80 are easily inserted and properly aligned before adhesively engaging the sheets within the binder. The components of binder 120 are identical to those of binder 100 (FIG. 8), except for the protective tape 125 over the spline adhesive. Tape 125 comprises a continuous strip of release material which is folded over against itself at 126, to provide a lower layer 122 which is removably adhered to the spline adhesive 130 and an upper layer 123 which includes a terminal portion 128 protruding from binder 120. After properly aligning sheets 80, the user grasps and pulls strip portion 128 thereby removing tape 125 (FIG. 10). The user may then press sheets 80 against binder 120 to provide a secure bond between the adhesive coatings 60, 130.

Figure 11:
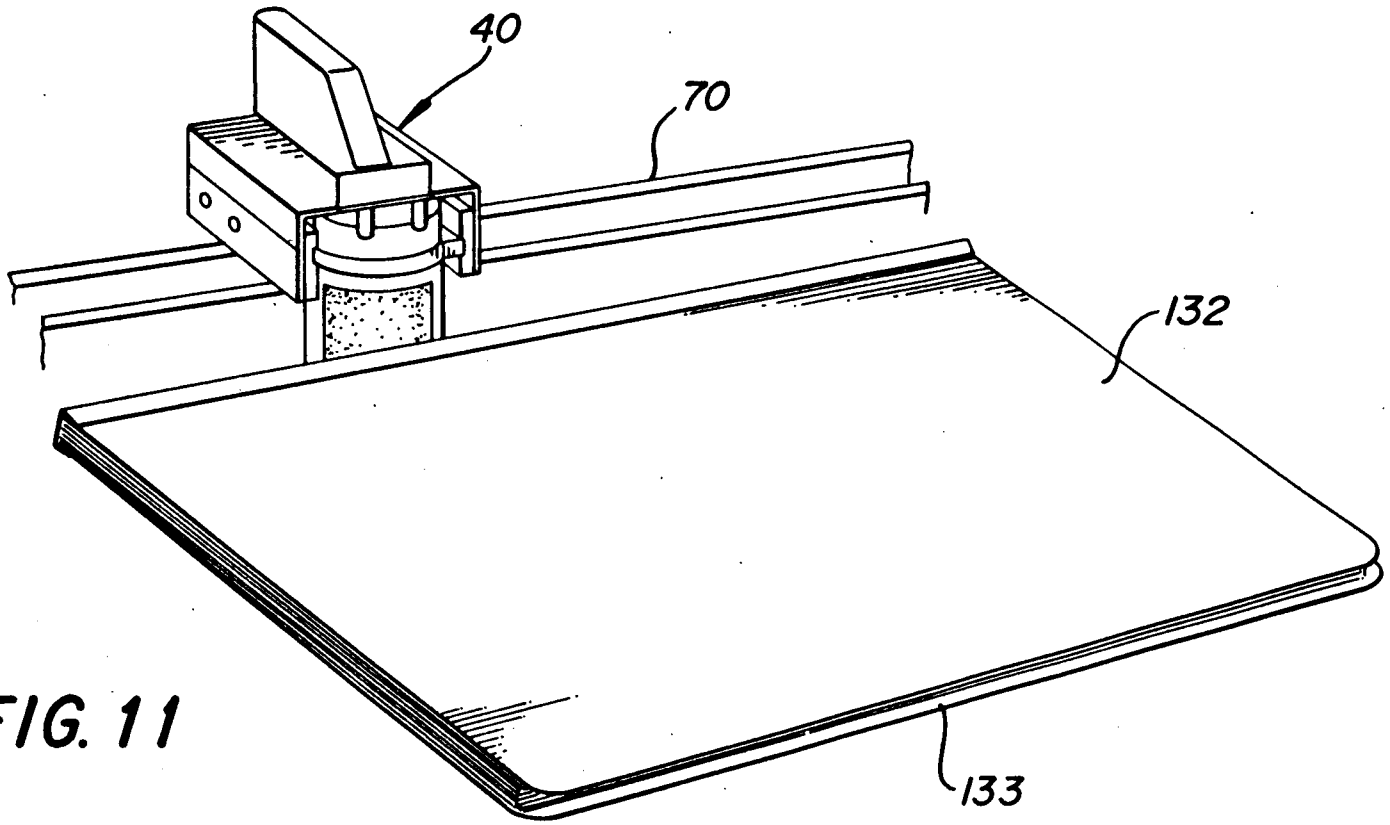
FIG. 11 is a perspective view of a third binding cover embodiment, with the clamping assembly not shown in order to illustrate the coating of the binding edges with adhesive.
Figure 11A:
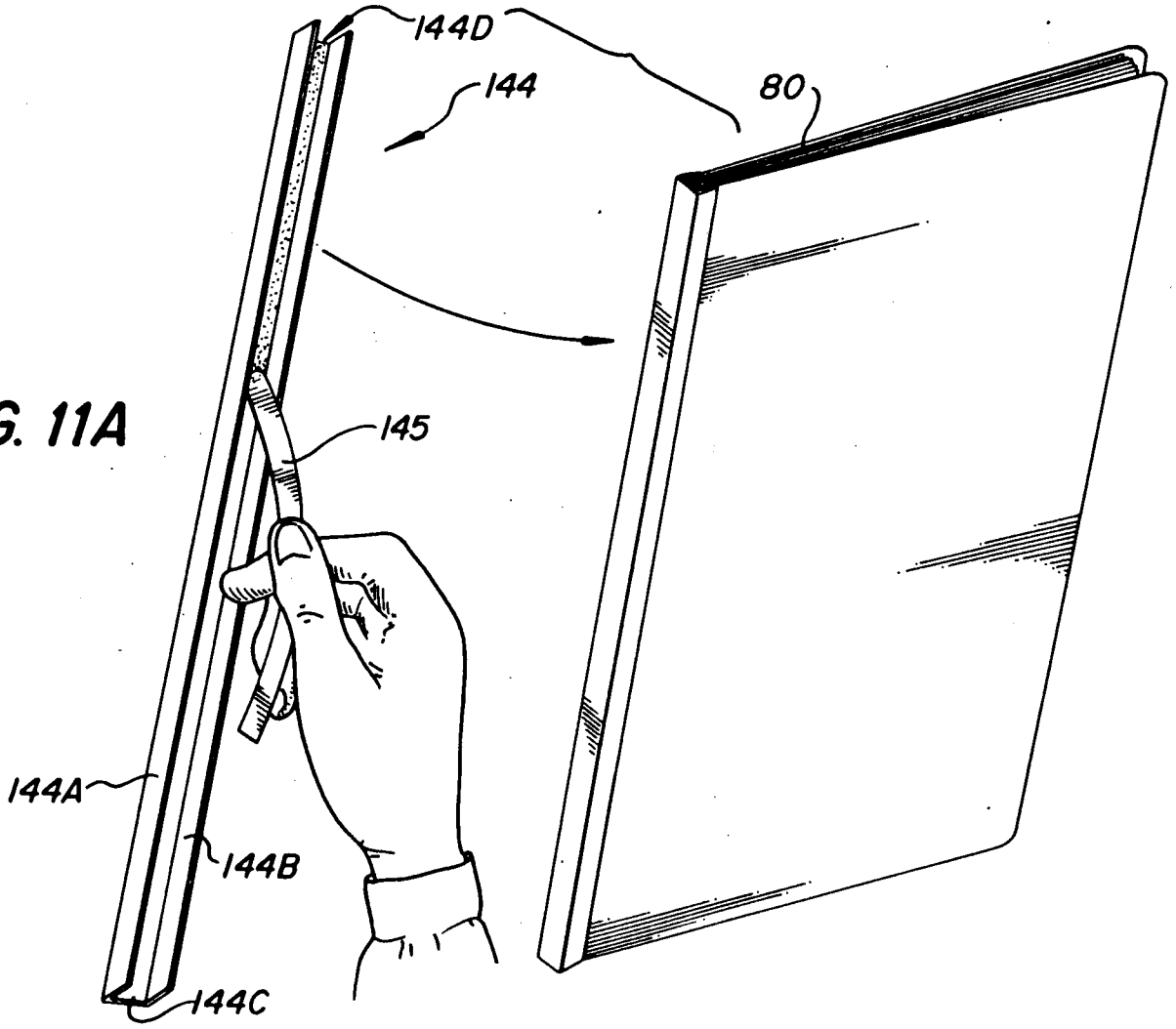
FIG. 11A is a perspective view of a fourth binding cover embodiment, showing the binding process in such embodiment.

As shown in FIGS. 11 and 11A, cover sheets 132, 133 may be included as the outermost sheets of a stack of sheets 135 to be clamped and coated with adhesive using apparatus 10 (of which only adhesive applicator 40 is shown in FIG. 11). This embodiment may employ a binder spline 144 identical to binder 100 (FIG. 8) or 120 (FIGS. 9,10) except for the omission of cover sheets. In order to create a bound report the user removes the protective tape 145 from binder spline 144, inserts sheets 80 into the spline channel, and aligns and presses together the spline 144 and adhesive coated sheets.

Figure 12:
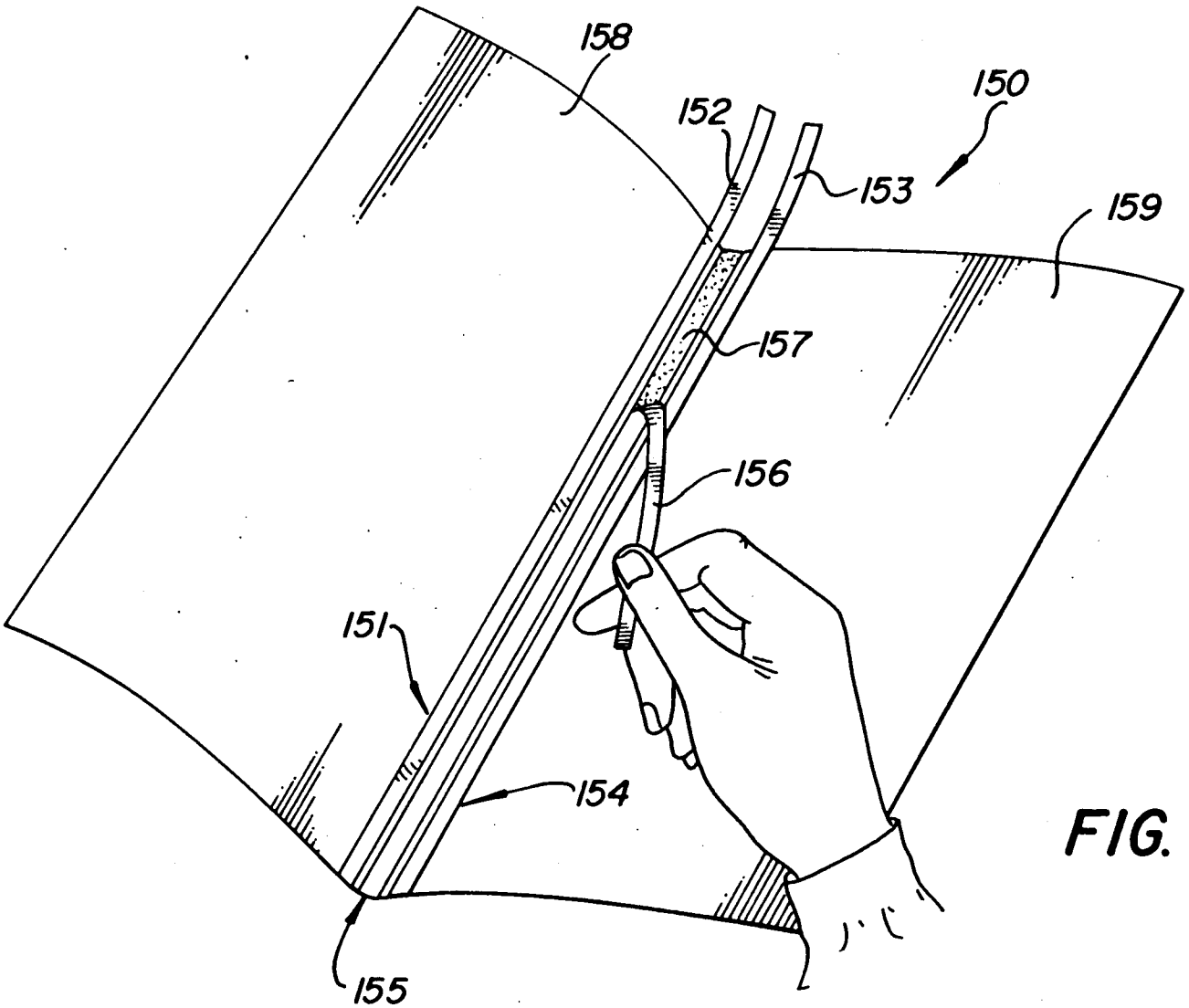
FIG. 12 is a perspective view of a fifth binding cover embodiment.
Figure 13:
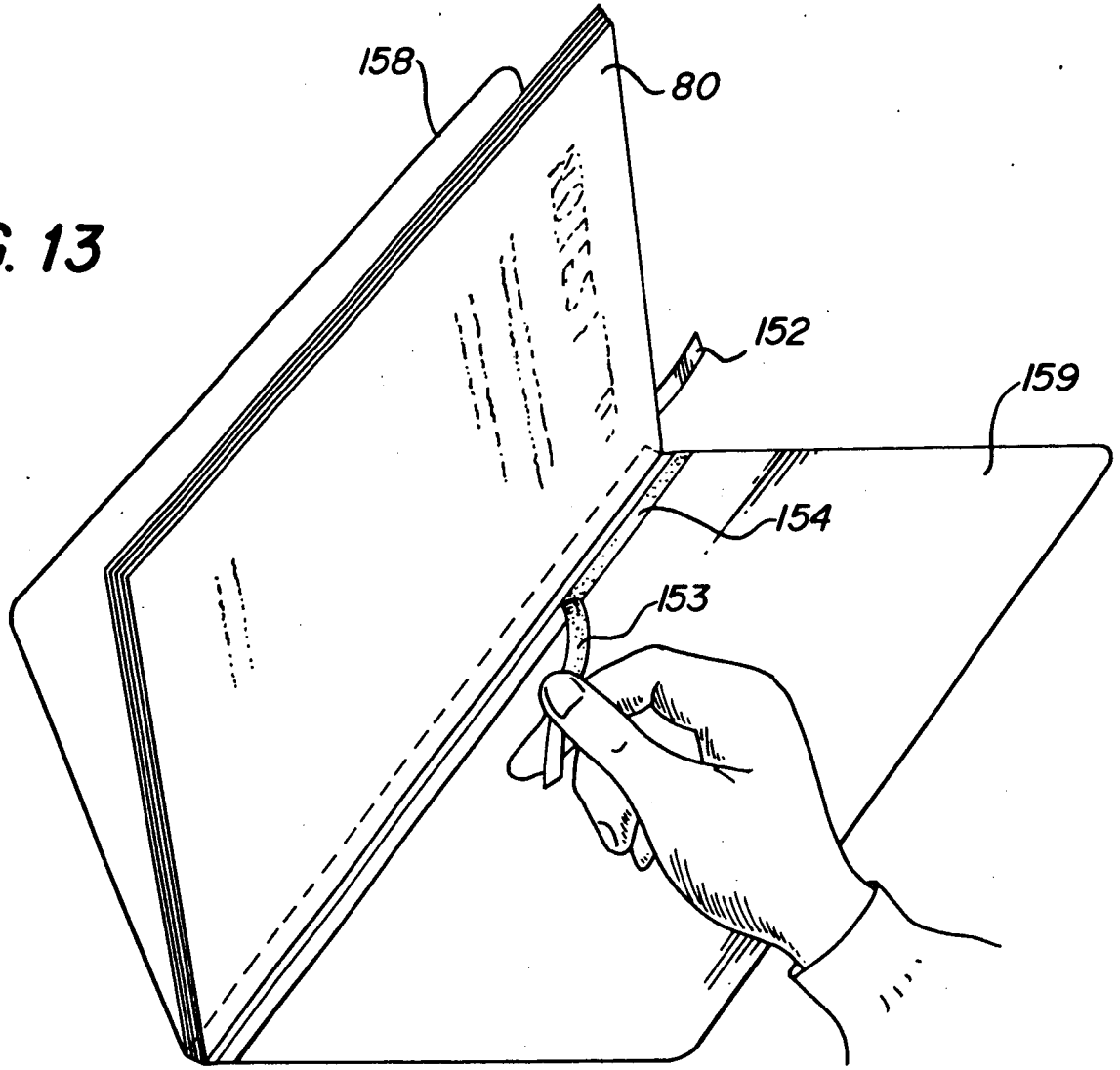
FIG. 13 is a perspective view of the binding cover embodiment of FIG. 12, with sheets inserted in preparation for additional securement of the sheets to ancillary adhesive zones.

FIGS. 12 and 13 illustrate yet another binder embodiment 150. In addition to the other components of the basic embodiment of FIG. 8, covers 158, 159 incorporate ancillary pressure sensitive adhesive strips 151, 154 with respective protective tape 152, 153 proximate the binder spline 155. After removing central protective tape 156 from the binder spline adhesive 157, and inserting, aligning, and adhesively securing sheets 80 within the spline channel, the user removes tapes 152 and 153 and presses the adhesive strips 151, 154 against bound sheets 80 to provide additional areas of engagement.

In an alternative to the binder embodiments of FIGS. 8–10, 12 and 13, the spline member may be omitted and the sheets 80 may instead by bound Within a unitary cover sheet which is pre-creased to define a spine and front and back cover sheets. This method of binding provides less structural support at the spine, but allows the bound sheets to lie flat.

We claim:

1. Apparatus for binding sheets of paper and other materials in sheet form, comprising means for clamping a stack of sheets with binding edges of said sheets essentially in alignment along an edge plane;

a cartridge holding a supply of a liquid adhesive, which cartridge is removably mounted to said apparatus to permit replacement with a new cartridge when supply of liquid adhesive is exhausted;

said cartridge being slidably mounted to move lengthwise along said binding edges, so as to progressively lay down a coating of the adhesive along said binding edges.

2. Apparatus for binding sheets of paper and other material in sheet form, comprising means for clamping a stack of sheets with binding edges of said sheets essentially in alignment along an edge plane; and means for coating the binding edges of said sheets with a liquid adhesive, wherein the clamping means and coating means are mounted to a frame, the coating means being mounted to the frame so as to be slidable lengthwide along said binding edges so as to progressively lay down the adhesive coating along the binding edges, and wherein the frame and a housing for the applicator member and liquid adhesive are configured to provide a cam-cam follower structure which causes the housing to telescope and expose the applicator member while sliding the member along the binding edges of the clamped sheets.

3. Apparatus as defined in claim 2 wherein the telescoping housing comprises a cover for the applicator member and a receptacle for the liquid adhesive slidably mounted within the cover so that it may be telescoped to expose the applicator member through a window in the cover.

4. Apparatus as defined in claim 2 wherein the clamping means comprises a tray having an edge surface for aligning the sheets, a panel substantially parallel to the tray and mounted to provide an adjustable separation of the panel and tray, and means for adjusting the separation of the tray and panel.

5. Apparatus as defined in claim 4 wherein the tray and panel are pivotally mounted to move between a position at which sheets may be inserted between them for alignment of the binding edges of the sheets against a stacking surface on said frame, and a position at which the sheets are clamped in place and the binding edges are exposed for coating with said liquid adhesive.

* * * * *